United States Patent [19]

Cleland

[11] 4,160,512

[45] Jul. 10, 1979

[54] LIQUID METERING AND BLENDING MEANS

[76] Inventor: Robert K. Cleland, 11051 Via El Mercado, Los Alamitos, Calif. 90720

[21] Appl. No.: 856,313

[22] Filed: Dec. 1, 1977

[51] Int. Cl.[2] ..... B67D 5/56

[52] U.S. Cl. ..... 222/56; 137/599.1; 222/129.2

[58] Field of Search .... 222/129.1, 129.2, 129.3, 129.4, 133, 318, 56, 504; 137/599.1, 604

[56] References Cited

U.S. PATENT DOCUMENTS

| | | | |
|---|---|---|---|
| 2,830,743 | 4/1958 | Rimsha et al. | 222/504 X |
| 2,965,268 | 12/1960 | Bauerlein | 222/504 X |
| 3,857,409 | 12/1974 | Aubrey et al. | 137/604 |
| 4,042,151 | 8/1977 | Uttech | 222/129.2 |

*Primary Examiner*—Robert J. Spar
*Assistant Examiner*—Francis J. Bartuska
*Attorney, Agent, or Firm*—Georges A. Maxwell

[57] ABSTRACT

An automatic, intermittently operable proportional mixing attachment for non-carbonated beverage dispensing machines having holding tanks in which beverages, reconstituted from proportional volumes of water and liquid concentrate, are stored; said attachment including an aspirator, a water delivery structure for the aspirator and connected with a pressurized water service system, a liquid beverage concentrate delivery structure for the aspirator and connected with a static supply of liquid beverage concentrate, a beverage delivery structure extending from the aspirator to the beverage holding tank of a related dispensing machine, a normally closed solenoid operated on and off valve in the water delivery structure and a float actuated control switch for the on and off valve arranged with its float in the beverage in the holding tank and operated to open the on and off valve when the level of beverage in the tank drops below a predetermined minimum level; and a bypass to adjust the minus pressure established in the aspirator and the resulting volume of concentrate delivered into the aspirator and including a bypass between the upstream and downstream ends of the aspirator and a manually adjustable metering valve in said bypass.

5 Claims, 7 Drawing Figures

LIQUID METERING AND BLENDING MEANS

This invention has to do with a proportional mixing means for liquids and is more particularly concerned with an attachment for a beverage dispensing machine to intermittently and automatically deliver proportional volumes of water and liquid beverage concentrate into a beverage holding tank of the dispensing machine.

BACKGROUND OF THE INVENTION

In the food and beverage industry, machines for holding, cooling and dispensing non-carbonated beverages have been in wide and common use for many years. The most common and most widely used type or class of beverage dispensing machines of the general character referred to above is that class of machine which includes a box-like housing adapted to be engaged and supported on a counter top or the like, atop which a clear or transparent beverage holding tank is supported and in which elements and/or parts of refrigeration units, circulating pump means and dispensing valve means are housed. In such machines, the holding tanks have open tops which are normally closed by suitable removable covers of clear plastic. The circulating pump means operate to draw beverage from the bottoms of the tanks and include return pipes or the like to conduct the beverage to the tops of the tanks so that they can flow down and about the interior surfaces of the tanks for aesthetic purposes and to keep the beverage mixed. The refrigeration units in machines of the class here concerned with commonly include compressor and condensing means within the housings and evaporator coils which project upwardly from the housing into the tanks to effectively chill the beverage in the tanks. The dispensing valve means commonly include simple on and off valves arranged within the housings. The inlet sides of the valves are suitably connected with the bottom of the holding tanks and the outlet sides are connected with suitable dispensing tubes which extend to a convenient location at the exterior of the housing for directing beverage into drinking cups or glasses. Finally, the valve means commonly include manually operable operating levers for the valves accessible at the exterior of the housing. The discharge ends of the outlet tube normally occur in spaced relationship above glass supporting catch basins at the lower front sides of the housings and the operating levers normally include bar-like parts at the fronts of the housings, spaced rearward of and below the dispensing tubes where they can be engaged to open their related valves by glasses or the like manually advanced into beverage receiving position below the tubes.

The principal shortcoming to be found in the above noted class of beverage dispensing machine resides in the fact that the supplies of beverage in the holding tanks must be periodically replenished. Such replenishing of the supply of beverage is ordinarily accomplished by removing the covers from the tanks and pouring measured amounts of water and of beverage concentrate into the open tops of the tanks as by means of water pitchers, mixing cups and the like. Such an operation is not only awkward and difficult, especially for persons with limited height, reach and/or poor coordination, it is also an unpleasant and oftentimes disagreeable operation for patrons of the establishments in which the machines are used to witness.

As a result of the above, it is common practice for the operators of such machines to avoid replenishing the supply of beverage in the holding tanks of such machines until it is absolutely necessary.

The above practice of waiting to replenish the supply of beverage in the holding tanks of the above noted class of beverage dispensing machine brings about an added adverse effect. That effect is the inability of the machine to effectively and adequately cool or chill large, unchilled volumes of newly introduced beverage instantly or even in a modestly short period of time. As a result, after the supply of beverage in such machines has been let to diminish substantially and has been replenished with a substantial period of time must be let to pass to enable the refrigeration unit to chill the beverage and before adequately chilled beverage can again be dispensed.

Another shortcoming found in the operation and use of the above noted class of machine resides in the fact that the required hand-measuring of the water and beverage concentrates is oftentimes improperly carried out. It is not infrequent that insufficient or excessive volumes of concentrate will be used in establishing new batches of beverage, with the result that the beverages are too weak or too strong. The use of insufficient volumes of concentrate and the dispensing and sale of weak beverage results in disappointed customers and a potential loss of trade for the operator, while the use of excessive volumes of beverage concentrate and the dispensing and sale of beverage which is too strong most generally results in the loss of profits for the operators of such machines.

As a result of the foregoing, there has been a long existing need and want for a simple, practical and effective means for automatically, intermittently mixing small measured volumes of water and liquid beverage concentrate and delivering the mixture directly into the holding tanks of beverage dispensing machines of the character referred to above to maintain a full and ready supply of beverage at all times.

A further want and need exists for a means of the general character referred to above which operates to conduct both water and beverage from remote, obscure sources directly into the holding tank of such machines without the need to remove the covers from the holding tanks.

Still further, there exists a want and need for a means of the general character referred to above which is such that small volumes of water and beverage concentrate can be mixed and introduced into the holding tanks of the dispensing machines at frequent intervals and as circumstances require whereby the volumes of unchilled liquids or beverage added to the tank at any one time is insufficient to warm or remove the chill from the previously established supply of beverage in the holding tanks.

OBJECTS AND FEATURES OF THE INVENTION

An object and feature of my invention is to provide a novel automatic means for receiving water and beverage concentrate for mixing the water and concentrate in predetermined volumes and for delivering the mixed water and concentrate or newly constituted beverage directly into the holding tank of a related beverage dispensing machine.

Another object of the present invention is to provide a means of the general character referred to which connects with and receives water from a pressurized water service system and which utilizes the service water as the motive force for drawing and delivering fluid beverage concentrate from a remote concentrate supply.

Yet another object and feature of the present invention is to provide a means of the character referred to above which is such that the volume of concentrate drawn and delivered is proportional to the volume of service water flowing into the means and wherein the concentrate and water are commingled and mixed within said means whereby newly concentrated beverage flows from said means.

It is an object and feature of my invention to provide a means of the general character referred to above which includes a fluid aspirator means with a low pressure upstream end and a downstream end, a concentrate conducting duct receiving concentrate from the concentrate supply and opening at the low pressure end of the aspirator means whereby the concentrate is drawn into and through the aspirator means by and with water directed through it, and beverage delivery means communicating with the downstream end of the aspirator means and extending into the holding tank of a related beverage dispensing machine.

A further object and feature of this invention is to provide a means of the general character referred to above which includes a liquid level control switch means responsive to the liquid level in a related holding tank and a related on and off valve means to start and stop the flow of water in response to the liquid level in the related holding tank.

Still another object and feature of the present invention is to provide a means of the character referred to above which includes bypass means between the upstream and downstream ends of the aspirator means, which bypass means includes a manually adjustable metering valve whereby the minus pressure established in the upstream low pressure end of the aspirator means and the corresponding flow rate and volume of concentrate drawn into and through the aspirator means can be adjusted and accurately controlled.

It is another object and feature of the present invention to provide a means of the general character referred to in the foregoing which is a small, neat lightweight and compact unit which is such that it can be advantageously and effectively engaged atop and supported by the holding tank cover of a related beverage dispensing machine.

Another object and feature of this invention is to provide a means of the character referred to wherein the holding tank cover engaging unit is provided with an elongate vertical beverage delivery tube which depends from the unit through an opening established in a related holding tank cover and thence into the holding tank below the fluid level in the tank whereby beverage delivered into the tank does not splash and generate undesirable foam, noise and the like and a means wherein the switching means includes an elongate probe depending from the unit and into the tank.

It is an object and feature of the present invention to provide a unitized means of the character referred to above which is such that it can be attached and related to any standard, conventional non-carbonated beverage dispensing machine holding tank by simply making a pair of small holes in the holding tank cover to receive the beverage delivery tube and the probe depending from the unit and a structure wherein said tube and probe serve to releasably retain or pin the means in position on and with the tank cover.

The foregoing and other objects and features of my invention will be apparent and will be fully understood from the following detailed description of one typical form and carrying out of the invention throughout which description reference is made to the accompanying drawings:

DESCRIPTION OF THE INVENTION

Figure 1:
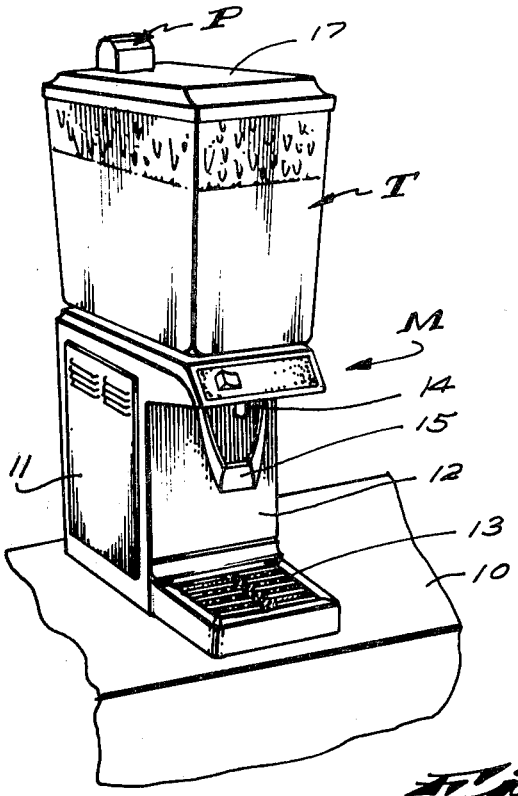
FIG. 1 is a perspective view of a beverage dispensing machine with my invention related to it.

In FIG. 1 of the drawings, I have illustrated a typical counter-top, non-carbonated beverage dispensing machine M. The machine M is shown mounted or set on top of a counter 10 and includes a lower housing 11 with a forwardly opening recess 12 to accommodate glasses or like receptacles into which beverage is to be delivered. A drop tray 13 is provided at the bottom of the recess 12. A beverage dispensing tube 14 depends into the recess from the top thereof and a beverage dispensing valve actuator 15 is arranged in the recess between and rearward of the tray 13 and the tube 14.

Figure 2:
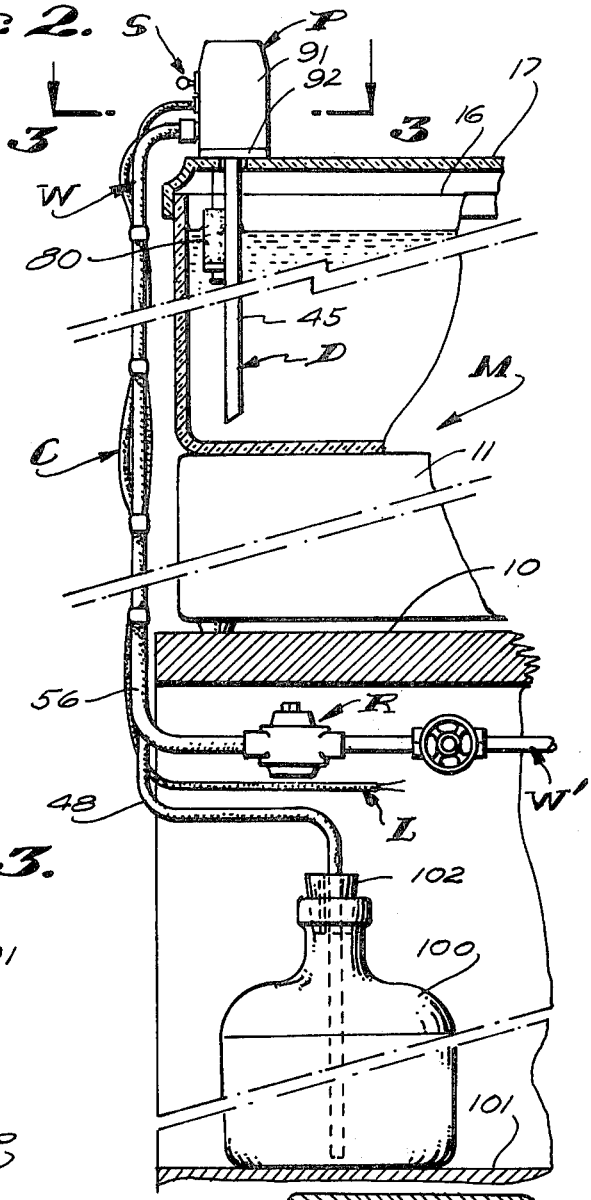
FIG. 2 is an enlarged detailed sectional view taken substantially as indicated by line 2—2 on FIG. 1.
Figure 3:
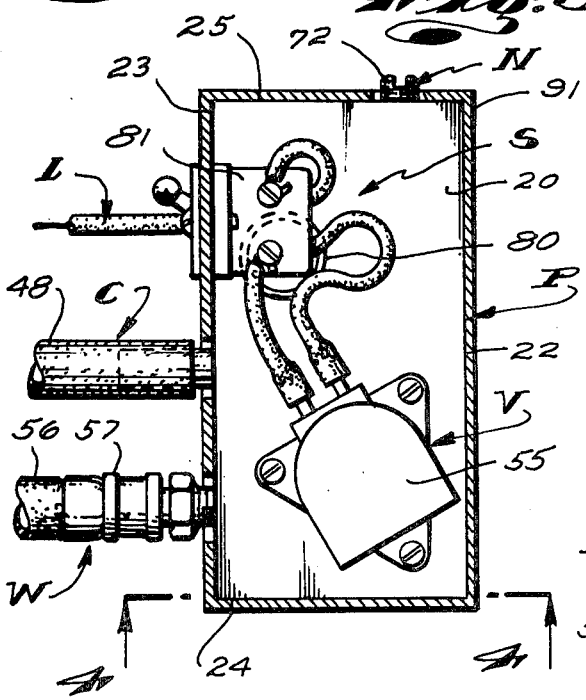
FIG. 3 is an enlarged sectional view taken substantially as indicated by line 3—3 on FIG. 2.
Figure 4:
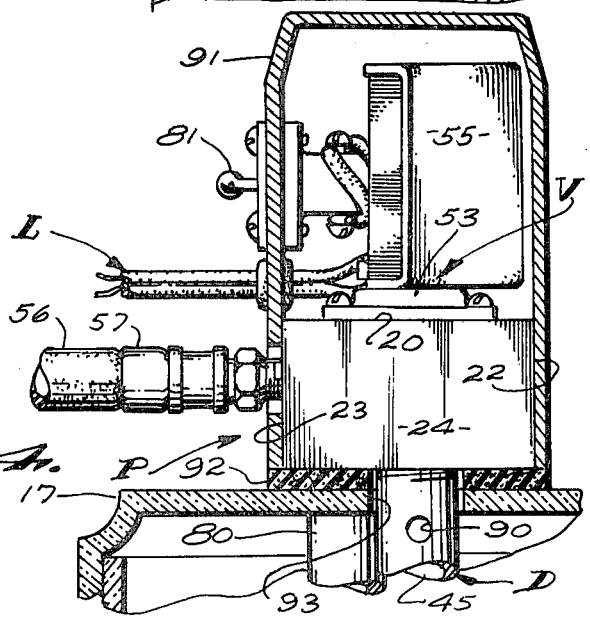
FIG. 4 is a sectional view taken as indicated by line 4—4 on FIG. 3.
Figure 5:
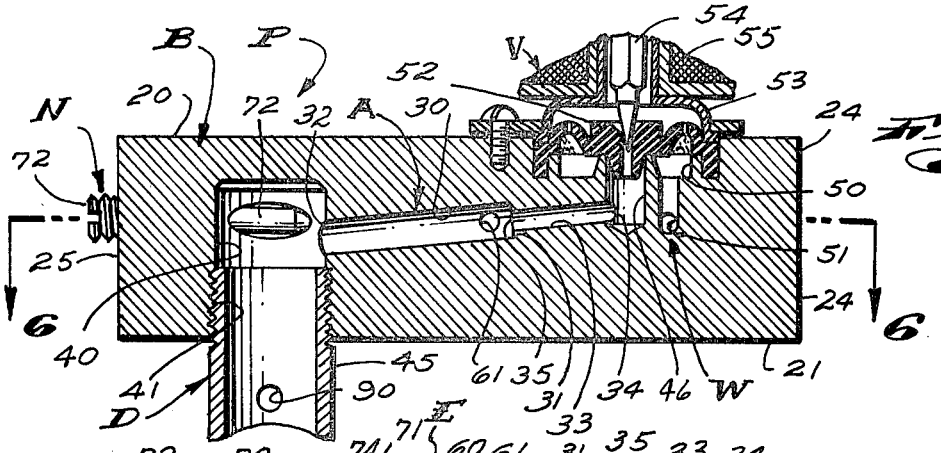
FIG. 5 is a sectional view taken as indicated by line 5—5 on FIG. 4.
Figure 6:
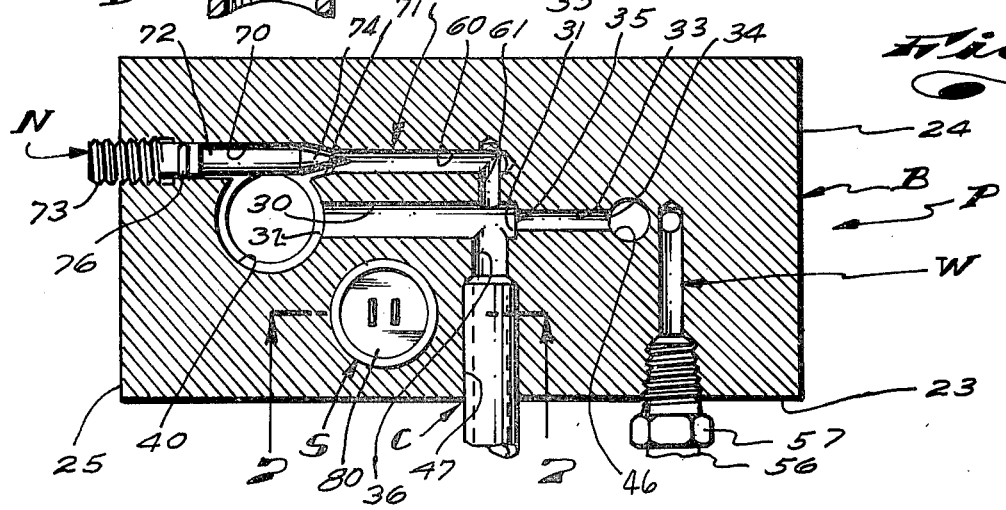
FIG. 6 is a sectional view taken as indicated by line 6—6 on FIG. 5.

Arranged and supported atop the housing 11 is a beverage holding tank T. The tank T is, in accordance with common practice, established of a suitable clear, transparent plastic material so that the contents or beverage within the tank can be viewed for merchandising or display purposes. The tank T has an open top 16 which is normally closed by a substantially flat horizontal cover 17, substantially as shown in FIGS. 1 and 2 of the drawings.

The housing 11 serves to enclose and support the whole or parts of a recirculating pump means (not shown) to maintain the beverage in the tank T circulating and mixed and of a refrigeration unit (not shown) to chill the beverage in the tank T. The pumping means commonly includes a drive motor in the housing to occur adjacent the bottom of the tank, a pump in the bottom of the tank and a magnetic drive coupling means between the motor and the pump (not shown). The refrigeration unit commonly comprises a compressor and condensor means in the housing and an evaporator coil which projects up from the housing through an opening in the bottom of the tank to occur in the beverage within the tank (not shown).

The housing 11 also houses a normally closed dispensing valve (not shown) which is connected with and between the tank T and the dispensing tube 14 and which is actuated or opened by means of the above noted valve actuator 15.

The machine M illustrated in the drawings and briefly described above is intended to show one typical class of machine with which my new proportional mixing means can be advantageously and effectively related. The details of construction and the design of the machine M can be varied widely without departing from or affecting the spirit of my invention. Accordingly, further detailed illustration and description of the machine M would only serve to unduly burden this disclosure and cloud the invention.

From the following, it will be apparent that the proportional mixing means that I provide is such that it can be advantageously related to any beverage dispensing machine or apparatus which includes a holding tank or vessel from which beverage is to be dispensed and which is such that the supply of beverage in the tank or vessel must be periodically replenished by the introduction of water and beverage concentrate in predetermined volumetric ratios.

The proportional mixing means P that I provide, and which is shown in the drawings, includes an aspirator means A, water delivery means W to conduct water to the means A, valve means V and switching means S controlling the flow of water through the delivery means W, concentrate delivery means C to conduct liquid beverage concentrate to the means A, beverage delivery means D communicating with and extending downstream from the means A and bypass means E to control operation of the means A.

The several means A, C, D, E, S, V and W noted above are established within or have parts and/or portions within a rectangular block-like body B established of a suitable metal or plastic material. The body B has flat top and bottom sides 20 and 21, flat front and rear sides 22 and 23 and flat right-hand and left-hand ends or sides 24 and 25.

The aspirator means A includes an elongate large diameter cylindrical aspirator chamber 30 with inlet and outlet or upstream and downstream ends 31 and 32; an elongate, small diameter, cylindrical water nozzle duct 33 with upstream and downstream ends 34 and 35 concentric with and extending axially from the upstream end of the chamber 30; and a lateral liquid or concentrate port 36 communicating with the upstream end of the chamber 30.

The means A is arranged substantially centrally in the body B with the chamber 30 and nozzle duct 33 extending substantially horizontally and longitudinally thereof with their downstream ends disposed toward their right-hand end 25 of the body, their upstream ends disposed toward the left-hand end 24 of the body and with the port 36 extending toward the rear side 23 of the body.

The downstream end of the chamber 30 communicates with the large diameter receiving chamber 40 in the body defined by the upper end portion of an elongate vertical cylindrical bore 41 entering the bottom side 21 of the body.

The lower portion of the bore 41 below the receiving chamber 40 is a part or portion of the beverage delivery means D, which means, in addition to the bore 41 includes an elongate vertical, large diameter delivery tube 45 with an upwardly opening upper end portion threaded or otherwise engaged in the bore 41. The tube 45 depends freely from the body and has an open lower end.

The upstream end 34 of the nozzle duct 33 communicates with the downstream side of a vertical, upwardly opening valve chamber 46 (of the valve means V) which is established in the body from the top side thereof.

The port 36 is concentric and communicates with a horizontal forwardly extending concentrate inlet duct 47 of the means C, entering the rear side of the body B.

The means C, in addition to the duct 47, includes an elongate, preferably flexible, suction hose 48. The hose 48 has a downstream end which is suitably coupled with or sealingly engaged in the duct 47 and a lower upstream end which is adapted to be engaged in a supply of liquid beverage concentrate, as will hereinafter be described.

With the structure thus far described, it will be apparent that when water, under pressure, is introduced in the upstream end of the nozzle duct 33 and flows therethrough, a high velocity jet of water is directed longitudinally through the chamber 30 from the upstream end to the downstream end thereof and that a minus pressure is established in the upstream end portion of the chamber 30, about the jet. The minus pressure established in the upstream end portion of the chamber is communicated with or established in the port 36 and in the hose 48 of the means C and operates or functions to draw liquid beverage concentrate from a related supply of concentrate through the hose 48 and the port 36. The concentrate flowing through the port 36 and into the chamber 30 combines and/or mixes with the jet of water flowing downstream through the chamber. The combined or mixed water and concentrate establishes the desired beverage and the beverage thus established flows freely from the downstream end of the chamber into the chamber 40. The beverage flowing into the chamber 40 flows freely downwardly from within that chamber into and through the tube 45 of the means D and into the related tank T.

The valve means V related to and controlling the flow of water in and through the water supply means W can vary widely in form without departing from the spirit of my invention.

In the case illustrated, the valve means V is an electrically operated or solenoid operated diaphragm type on and off valve incorporated in the body B. The valve in addition to the aforementioned vertical chamber 46 which communicates with the nozzle duct 33 of the means A includes an annular, upwardly opening inlet chamber 50 about the upper end of the chamber 46 and communicating with a water inlet passage 51 entering the rear side 23 of the body; a flexible diaphragm 52 overlying the chamber 46 and 50; a bonnet 53 with a vertically extending tubular armature guide is releasably secured to the top of the body to overly and hold the diaphragm in place. A vertically shiftable valving armature 54 is arranged within the guide. A spring means (not shown) is within the guide to normally yieldingly urge the member 54 and the diaphragm 52 down in closed position where flow of water from the chamber 52 to the chamber 46 is stopped. Finally, the valve includes an electro-magnetic coil unit 55 carried by the bonnet and engaged about said guide and operable, when energized, to elevate the armature valving member 54 to an up or open position. When the coil is energized and the member 54 is elevated, water, under pressure in the chamber 50 is free to lift the diaphragm and permit the flow of water from the chamber 50 into the chamber 46.

The valve V, in addition to the above, can include means for normally hydraulically balancing the diaphragm. Since such means does not directly affect and/or form a part of my invention, detailed description thereof will not be undertaken.

With the valve means V set forth above, it will be apparent that the valve can be opened and closed to start and stop the flow of water into and through the construction and that operation thereof can be effected by suitable switching means, such as the switching means S, which will hereinafter be described.

It is to be noted and it will be apparent that the valve V illustrated and described above can be replaced by any one of a number of other common forms or types of electrically operated valve and could, if desired, be replaced by one of a number of different, common, manually operated on and off valves without materially affecting or departing from the spirit of my invention.

The bypass means E to control operation of the aspirator means A includes a bypass duct 60, extending between and communicating with the chamber 40 at the downstream end of the chamber 30 and with the upstream end of the chamber 30. The means E next includes a manually adjustable metering valve means N related to and controlling the flow of gas and/or liquid through the duct 60.

When the valve means N is in a fully open position, flow through the duct 60 is unrestricted and the pressure within the upstream end of the chamber 30 is substantially balanced with the pressure in the chamber 40, that is, the minus pressure established in the chamber 30 by the jet of water issuing from the nozzle duct 33 draws liquid or gas through the duct 60 from the chamber 40 at such a rate that no effective minus pressure is established in the chamber 30 and no concentrate is drawn into the chamber 30 through the means C. As the valve means N is closed to restrict flow through the duct 60, the minus pressure established in the chamber 60 increases (inversely) and the ability of the construction to draw concentrate through the means C into the chamber increases substantially proportionately with the increase in minus pressure.

With the bypass means E noted above, it will be apparent that by adjusting the valve means N and controlling the minus pressure established in the aspirator means A, the volume of concentrate drawn into the chamber 30 and mixed with the water flowing through and from that chamber can be accurately controlled and the proportioning of water and concentrate going to make up the beverage discharged by the construction can be easily and accurately controlled.

In the case illustrated, the valve means V is a needle valve structure and includes an elongate cylindrical valve chamber 70 entering the right-hand 24 of the body and extending longitudinally in the body so that one side thereof intersects and communicates with one side of the cylindrical chamber 40. The inner end of the chamber 70 has an annular tapered seat 71 which communicates with the passage 60.

The valve N next includes an elongate needle type valve member 72 with an outer portion 73 threadedly engaged in the outer portion of the chamber 70 and normally accessible at the exterior of the body B and an inner portion 74 extending freely through the chamber and having a tapered tip 75 cooperatively related with the seat 71 to effect metering of fluids flowing through the valve structure.

In practice, the valve member carries a suitable seal 76 to seal the chamber 70 from the ambient atmosphere.

The passage 60 of the means E is concentric with and extends inwardly from the chamber 70 and seat 71 to join and communicate with a lateral branch like duct 61 which communicates with the upstream portion of the chamber 30. The branch duct 61 is concentric with the port 36 and occurs at the opposite sides of the chamber 30 from the port 36.

The water delivery means W, in addition to the duct 51 entering the rear side of the body, and communicating with the chamber 50 or inlet side of the valve means V includes an elongate water hose 56 with upstream and downstream ends. The downstream end of the hose is provided with a suitable coupling 57, screw threaded in a coupling receiving opening entering the rear side of the body and communicating with the duct 51. The other or upstream end of the hose (not shown) extends to and suitably connects with a water service outlet or faucet in the area or facility in which the construction is used.

Figure 7:
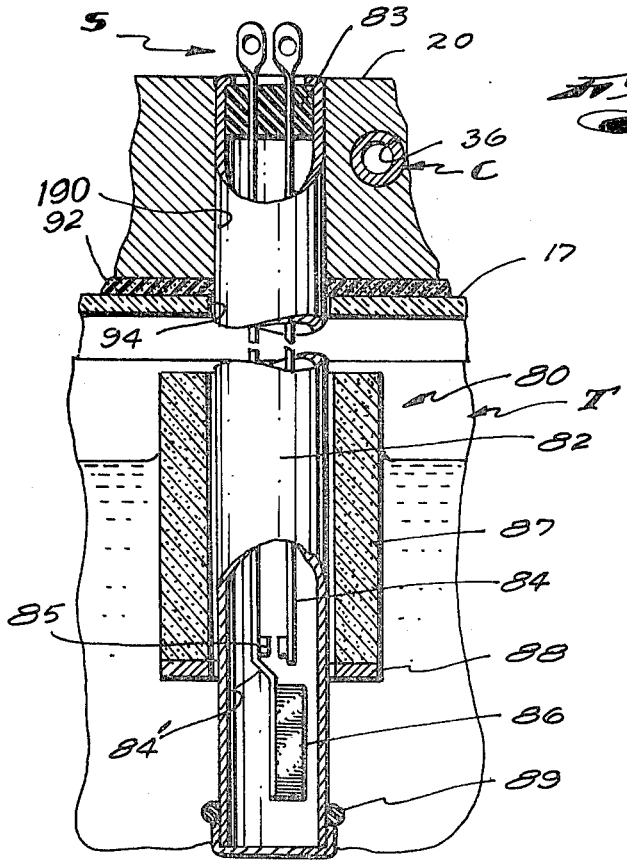
FIG. 7 is a view taken as indicated by line 7—7 on FIG. 6.

In the preferred carrying out of my invention the switch means S includes a fluid level responsive switch D and a manually operated master switch 81. The switch 80 is a float actuated magnetically operated reed switch unit or device such as is shown in FIG. 7 of the drawings. The switch 80 includes an elongate, tubular, non-ferrous, probe 82 with a closed lower end and a plug 83 engaged in and closing its upper end, a pair of elongate vertical non-ferrous resilient reeds 84 and 84' arranged within the probe in spaced parallel relationship and with their upper end portions extending through the plug 83 to establish terminals at the top, exterior of the probe. The lower end portions of the reeds are provided with normally spaced contact points 85. One reed (the reed 84') has an extension at its lower end on which a bar magnetic 86 is suitably fixed. An annular non-ferrous float 87 is engaged about the exterior of the probe for free, vertical, longitudinal shifting relative thereto. The float 87 carries a ferrous ring 88.

In practice, a suitable stop 89 is provided at the lower end of the probe to releasably retain the float engaged about the probe.

The above switch construction is such that when the ring 88 is moved axially downwardly into a common radial plane with the magnet 86, the magnet, attracted to the ring, moves its related reed 84' toward the reed 84, closing the switch.

The switch 80 here provided has a suitably wide operating range, that is, it is necessary that the float 87 and its ferrous ring 88 move a substantial distance longitudinally of the probe and relative to the magnet 86 to effect closing and opening of the contacts 85. This wide range of operation is the result of the differences in the field gap between the magnet and the ring when the switch is in its open and closed position.

The upper end portion of the probe 82 is engaged in a vertical through opening 190 provided in the body B with its terminals established by the upper end portions of the reeds, accessible at the top of the body. The terminals of the switch 80 are connected in or with one leg of an electrical power line L which extends from the coil unit 55 to a suitable electric service outlet (not shown) in the area or facility in which the construction is used.

The remainder of the switch 80 depends freely from the body.

The master control switch 81 is a simple manually operable toggle switch or the like, connected in the power line L in series with the switch 80 and is provided so that the power to the coil unit 55 can be positively shut off and the construction can be taken out of service, when desired or when circumstances require.

It is to be noted that the several openings, ducts, chambers and ports within the body B are arranged and disposed so that they can be easily and effectively established in the body by suitable drilling and plugging operations. Further, the construction of the body, with the several chambers, ducts, ports and/or passages established therein lends itself to inexpensive mass production through injection molding techniques and the like.

In furtherance of my invention, the block like body B is provided with an inverted cup-like decorative cap 91 to obscure the valve structure V at and projecting upwardly from the top of the body, to obscure switching means S and to overlie and obscure the front, rear and end side surfaces of the body.

In practice, and as shown in the drawings, the switch 81 of the means S can be advantageously mounted within the cap 91 with its manually engageable actuator projecting through an opening in the cap for normal engagement at the exterior thereof.

In the preferred carrying out of my invention, the structure next includes a soft sponge rubber mounting pad 92 on the bottom of the body B to engage the top surface of the holding tank cover 17 of the beverage dispensing machine M with which the body is related.

The top of the cover 17 is provided with an opening 93 in and through which the beverage delivery tube 45 of the means D is slidably engaged and an opening 94 in and through which the probe 82 of the switch 80 is slidably engaged. With the body tube and probe related to the cover 17 as noted above, it will be apparent that the body is effectively retained in position, on top of the cover, by the tube and probe. The tube 45, engaged through the opening 93 depends freely from the cover 17 into the interior of the tank T to terminate in the lower portion of the tank, within the supply of beverage therin and the probe 82 depends from its related opening 94 in the top 17 to depend freely into the tank and into the supply of beverage therein.

In practice, a supply of concentrate is contained by a suitable vessel remote from the machine and the upstream end of the suction hose 48 of the means C is extended into the vessel and into the supply of concentrate therein.

In the case illustrated, the vessel for the supply of concentrate is a glass bottle 100 supported on a shelf 101 beneath the counter 10 on which the machine M is supported. The bottle 100 has a vented stopper 102 through which the upstream end portion of the suction hose 48 is engaged. The hose 48 extends down into the bottle to terminate in the bottom portion thereof.

In practice, since the supply of concentrate in the bottle 100 occurs a substantial distance below the means P atop the tank cover 17, a substantial hydrostatic head pressure is established in the suction hose 48 between the bottle and the means P.

The head pressure in the suction hose, though substantial, is equal to but a fraction of the minus pressure that can be established in and by the aspirator means A. Accordingly, in operation and in setting up and adjusting the structure that I provide, the means E is first operated to establish sufficient minus pressure in the aspirator means A to overcome the hydrostatic head in the hose 48, whereby concentrate is drawn from the bottle or supply of concentrate up to the aspirator means. Thereafter, the means E is operated to increase the minus pressure in the aspirator means A to that extent that the flow rate and/or volume of concentrate flowing into and through the aspirator means A is such that the beverage flowing from the aspirator means into the chamber 40 and thence through the means D into the tank T is of desired strength or concentration.

The lower end of the probe 82 of the switch 80, which depends from the cover 17 into the beverage in the tank T, depends into the beverage a sufficient distance so that the float 87 about the probe is floated in the beverage and so that when the level of the beverage in the tank is at its top or uppermost point, the ferrous ring 88 of the switch 80 is spaced vertically above and relative to the magnet 86 to a position where the force exerted between the magnet and the ring is insufficient to hold the resilient reed 84' in a laterally displaced or biased closed position and allows the reed 84' to return and assume its normal open position.

When and as the liquid level in the tank T drops, the ferrous ring 88 carried by the flow 87 moves downwardly toward the magnet 86 until such time as the gap between the magnet and the ring is reduced to that extent where the force of the magnetic field acting on the ring is sufficient to bias the resilient reed 84' and move it to its closed position.

By suitably adjusting or varying the buoyancy of the float, as by increasing or decreasing its effective cross-section, the distance which the float must move to effect opening and closing of the switch 80 can be adjusted. By so adjusting the operating range of the switch 80, it is both easy and practical to adjust and set the volume of beverage that is dispensed before the means that I provide is put into operation to replenish the supply of beverage. For example, where the holding tank T holds a minimum of two gallons of beverage, the means that I provide can be adjusted and set so that the supply of beverage is replenished each time the supply is reduced by about one, two or three quarts, as desired or as circumstances require.

In practice, the upper end portion of the beverage delivery tube 48, above the level of beverage in the tank T is provided with a lateral anti-syphon vent opening 90. The opening 90 serves to prevent the tube 48 from filling with beverage and creating a reverse, syphon flow of beverage from the tank T, back through the body B, means C and into the bottle 86.

It is to be noted that with the invention here provided, the only work required to be performed on the machine M is establishment of the tube and probe accommodating holes 93 and 94 in the holding tank cover 17.

In practice, when it is desired to service or clean the machine M, the tank cover T with the means P that I provide related to it, can be easily and quickly removed from engagement with the tank T. Further, if it is desired that the means P be cleaned separately or independently and/or if it is required that the cover 17 be cleaned separately, the means P can be easily and quickly separated from the cover by simply removing the float 17 from the probe 82 and then manually lifting the the body from engagement therewith and extracting the tube 45 and probe 82 from within the openings or holes 93 and 94 in the cover 17.

In practice, aspirator means such as the aspirator A that I provide operate effectively within narrow pressure ranges. Accordingly, the aspirator means A can be designed to operate efficiently at or under the normal pressure provided in some particular water service system or can be made to operate effectively at some lesser pressure which is well below the range of pressure provided in the overwhelming majority of water service systems. In the latter case, and to effect efficient operation of my invention, a suitable pressure regulator R is provided in the water supply means W. In the case illustrated, the regulator R is shown in the means W where it connects with a water service outlet W'.

It is to be noted and will be apparent from the foregoing that if desired, the aspirator means A can be varied considerably in design and can, if desired, or if circumstances require, be replaced by a venturitype of means which would function in substantially the same manner as the means A and attain the same desired end results.

It is to be further noted and it will be apparent that if desired, or if circumstances require, other common forms of float actuated switching devices might be substituted for the special form of switching device 80 illustrated and described above without materially affecting the novelty or departing from the spirit of my invention.

From the foregoing, it will be apparent that I provide a novel, simple, practical and effective means for automatically maintaining a full supply of properly reconstituted beverage in the holding tank of a noncarbonated beverage dispensing machine and thereby effectively eliminate and/or overcome the majority of shortcoming and undesirable problems which have long been associated with a daily operation and use of such machines.

Having described only one typical preferred form and application of my invention, I do not wish to be limited to the specific details herein set forth, but wish to reserve to myself any modifications and/or variations that may appear to those skilled in the art and which fall within the scope of the following claims:

Having described my invention, I claim:

1. A proportional mixing device in combination with a non-carbonated beverage dispensing machine including a beverage holding tank with a top wall having a vertical through opening; said device is operable to intermittently deliver volumes of water with proportional volumes of liquid additive admixed therewith into the tank and includes a unitary body with a bottom surface in supported engagement with said wall, an elongate aspirator chamber with upstream and downstream ends within the body, an elongate nozzle passage with upstream and downstream ends, within the body with its downstream end concentic with and communicating with the upstream end of the aspirator chamber, an elongate water supply duct with upstream and downstream ends in the body with its downstream end communicating with the upstream end of the passage and its upstream end connected with a pressurized water supply remote from the body and the machine, an on and off valve means in the body and interposed between the ends of the water supply duct, a liquid additive port in the body communicating with the upstream end portion of the aspirator chamber, an elongate suction hose with a downstream end portion entering the body and communicating with the port and an upstream end portion extending from the body into a static supply of liquid additive remote from the body and the machine, a receiver chamber communicating with the downstream end of the aspirator chamber, an elongate delivery tube with an upper end portion entering the bottom of the body and communicating with the receiver chamber and a lower end portion depending from the body through said through opening and into said tank below a normal liquid level therein, an anti-syphon vent in the upper portion of said delivery tube, and bypass means to control the flow rate and volume of additive into and through the device and including an elongate bypass duct in the body, having an upstream end communicating with the receiver chamber and a downstream end communicating with the upstream end of the aspirator chamber and manually operable metering valve means in the bypass duct and operable to adjust the pressure differential between the receiver chamber and the upstream end portion of the aspirator chamber.

2. The device set forth in claim 1 wherein said metering valve means includes an elongate metering valve chamber in the body and having an outer end portion opening at the exterior of the body, a central portion intersecting the receiver chamber and an inner end communicating with the bypass duct and defining a tapered annular valve seat, and an elongate valving member with a manually engageable outer end portion threaded into the outer end portion of the metering valve chamber and an elongate inner end portion with a tapered inner end extending freely through the central and inner end portions of the metering chamber and shiftable axially to adjust the relative axial position of its tapered inner end with said tapered seat.

3. The device set forth in claim 2 wherein the on and off valve means is a normally closed solenoid operated valve and a device which further includes a power line extending from a power supply to the valve and a normally open float actuated switch in the tank and connected in said power line and operating to close when the supply of beverage in the tank drops to a predetermined level.

4. The device set forth in claim 3 wherein the pressurized water supply outside the body includes an elongate water hose with upstream and downstream ends, means coupling the downstream end with the upstream end of the supply duct in the body, means coupling the downstream end with said pressurized water service system and a pressure regulator between the ends of the hose.

5. The device set forth in claim 1 wherein the on and off valve means is a normally closed solenoid operated valve and a device which further includes a power line extending from a power supply to the valve and a normally open float actuated switch in the tank and connected in said power line and operating to close when the supply of beverage in the tank drops to a predetermined level.

* * * * *